US007338304B2

(12) United States Patent
Kameyama et al.

(10) Patent No.: US 7,338,304 B2
(45) Date of Patent: Mar. 4, 2008

(54) CASE MEMBER HAVING CONNECTOR PORTION

(75) Inventors: Isao Kameyama, Makinohara (JP); Takashi Toi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/584,143

(22) PCT Filed: Apr. 28, 2005

(86) PCT No.: PCT/JP2005/008171

§ 371 (c)(1),
(2), (4) Date: Jun. 22, 2006

(87) PCT Pub. No.: WO2005/109579

PCT Pub. Date: Nov. 17, 2005

(65) Prior Publication Data

US 2007/0123085 A1 May 31, 2007

(30) Foreign Application Priority Data

May 10, 2004 (JP) ..... 2004-140195

(51) Int. Cl.
*H01R 13/52* (2006.01)

(52) U.S. Cl. ..... 439/281; 439/587; 439/271

(58) Field of Classification Search ..... 439/271, 439/274, 587, 588, 281, 282
See application file for complete search history.

(56) References Cited

U.S. PATENT DOCUMENTS 5,031,405 A 7/1991 Takahashi et al.
6,095,859 A * 8/2000 Maeda ..... 439/587
6,250,962 B1 * 6/2001 Shinozaki ..... 439/587
6,371,807 B1 * 4/2002 Takagishi et al. ..... 439/587
6,672,900 B2 * 1/2004 France et al. ..... 439/587
6,872,092 B2 * 3/2005 Oka ..... 439/587
2002/0101041 A1 8/2002 Kameyama

FOREIGN PATENT DOCUMENTS

JP 2-78463 U 6/1990
JP 6-86277 U 12/1994
JP 9-245880 A 9/1997
JP 2002-231375 A 8/2002

* cited by examiner

*Primary Examiner*—Hien Vu
(74) *Attorney, Agent, or Firm*—Sughrue Mion, PLLC

(57) ABSTRACT

There is provided a case member having a structure for preventing the pushing-out of a seal member caused by gas leakage within a connector portion and also for preventing an annular lip portion of the seal member from falling when fitting the connector portion and a mating connector to each other. In the seal member 13, the annular lip portion 13*f* extends in a direction of connecting of the connector portion 18 to the mating connector in surrounding relation to electrical contact portions 19*a* of connection terminals 19. A seal member holder 15 is fitted on an outer peripheral surface of the connector portion 18. An annular groove 15*f* for receiving the annular lip portion 13*f* of the seal member 13 is formed in this seal member holder 15.

2 Claims, 7 Drawing Sheets

CASE MEMBER HAVING CONNECTOR PORTION

TECHNICAL FIELD

This invention relates to a case member having a connector portion, and more particularly to a case member for receiving an electrical part in a sealed condition.

BACKGROUND ART

For example, a case member for receiving an on-vehicle CCD (Charged Coupled Device) camera unit (which is an electrical part) is required to have a high gas-tight performance (In other words, a high sealing performance) in order to protect the on-vehicle CCD camera unit from foreign matters such as dirt, dust, water and others.

By the way, generally, most of car batteries to be mounted on vehicles such as an automobile have a rated output voltage value of 12V (volt), and also there are other car batteries having a rated output voltage of 24V, 36V or other values.

On the other hand, an internal-operating voltage value of the on-vehicle CCD camera unit is lower (for example, on the order of 3V) than an output voltage value of the car battery, and therefore a DC/DC converter is provided at the on-vehicle CCD camera unit, and a voltage of electric power, supplied from the car battery, is converted into the internal-operating voltage of the on-vehicle CCD camera unit by this DC/DC converter.

A loss, developing in the DC/DC converter of the on-vehicle CCD camera unit during its voltage-converting operation, produces heat which markedly increases the temperature within the case member receiving the on-vehicle CCD camera unit in a sealed condition, and therefore taking a radiating performance into consideration, the case member, made of metal such as aluminum, has been used by choice.

For example, there is known a technique in which an on-vehicle CCD camera unit with a connector portion is incorporated in a case member made of aluminum, and a gap between the connector portion of the on-vehicle CCD camera unit and the case member is sealed by a seal member (rubber plug), thereby sealing the case member (see, for example, Patent Literature 1).

In recent years, the amount of heat generated from a DC/DC converter has been markedly decreased because of an enhanced voltage conversion efficiency, and it has now become unnecessary that a metal-made case member should be used as one for receiving the on-vehicle CCD camera unit provided with such DC/DC converter.

Therefore, for the purpose of achieving a lightweight design and also for cost-reducing and other purposes, there is a technical trend toward the use of a synthetic resin-made case member for receiving an on-vehicle CCD camera unit. In the development of such a synthetic resin-made case member, a study has been made of the integral molding of the case member with a connector having connection terminals for electrical connection to an on-vehicle CCD camera unit received in the case member, and more specifically a study has been made of the formation of the case member, having a connector portion having the connection terminals, by insert molding.

However, even when the insert molding is carried out, microscopic gaps are formed between the connection terminals and the molded resin, and therefore a seal member is provided at the connector portion, having the connection terminals, in intimately-contacting relation to the connection terminals. As one example of a connector employing such a seal member, there is known one in which the sealing is effected by a seal member through which connection terminals extend in intimately-contacting relation thereto (see, for example, Patent Literature 2).

In order to eliminate adverse effects of foreign matters such as dirt, dust, water and others, entering or intruding from the exterior, on a case member for receiving an on-vehicle CCD camera unit in a sealed condition, the case member is required to have such a sealing performance that leakage will not occur even when a pressure, for example, of 400 kPa, is applied thereto.

However, when a pressure is applied to the interior of the case member having the connector portion having the seal member disposed in intimate contact with the connection terminals as described above, there is a possibility that the seal member is pushed out by gas leaking through gaps between the connection terminals and the molded resin, and is displaced toward a mating connector insertion port of the connector portion, so that the sealing performance of the case member is affected.

Also, in the case where in order to obtain a higher sealing performance, a thin, annular lip portion is formed on a seal member, and extends in a direction of connecting of the connector portion to a mating connector in surrounding relation to electrical contact portions of connection terminals, there is a possibility that this annular lip portion is pressed by a front end portion of the mating connector to fall inwardly (that is, toward the connection terminals) into a folded condition during the fitting of the connector portion and the mating connector to each other, so that the mating connector is completely fitted into the connector portion in this condition. There is a high possibility that the desired sealing performance of the case member can not be obtained when such falling of the annular lip portion occurs, and therefore it is necessary to improve this.

Patent Literature 1: JP-A-2002-231375 (Pages 6 to 24, FIG. 1)

Patent Literature 2: JP-A-9-245880 (Pages 3 to 5, FIG. 1)

DISCLOSURE OF THE INVENTION

Problem that the Invention is to Solve

This invention has been made in view of the above circumstances, and its object is to provide a case member having a structure for preventing the pushing-out of a seal member caused by gas leakage within a connector portion and also for preventing an annular lip portion of the seal member from falling when fitting the connector portion and a mating connector to each other.

MEANS FOR SOLVING THE PROBLEM

A case member, comprising:

a case portion that has an electrical part chamber formed therein for receiving an electrical part;

a connector portion that is integrally formed with the case portion, and includes:

a seal member chamber;

a partition wall formed between the seal member chamber and the electrical part chamber to separate the seal member chamber from the electrical part chamber of the case portion; and a connection terminal fixed to the partition wall so as to pass through the partition wall, and has an electrical contact portion projecting into the seal member chamber;

a seal member that is disposed within the seal member chamber so that the electrical contact portion of the connection terminal passes through the seal member; and a seal member holder that is fitted on an outer peripheral surface of the connector portion, wherein the seal member has an annular lip portion extending in a connection direction in which the connector portion connects to a mating connector so as to surround the electrical contact portion of the connection terminal; and wherein the seal member holder has an annular groove which receives the annular lip portion of the seal member when the seal member holder is fitted on the connector portion.

In the case member of this construction, the seal member holder is mounted on the connector portion while the annular lip portion of the seal member is received in the annular groove of this seal member holder, and therefore this positively prevents a situation in which the mating connector is fitted into the connector portion, with the annular lip portion of the seal member falling inwardly (that is, toward the connection terminals) into a folded condition. And besides, even when the seal member tends to be pushed out by gas leaking from the case portion into the seal member chamber via gaps between the respective connection terminals and the partition wall, the seal member holder stops the seal member, and therefore the pushing-out of the seal member is also positively prevented.

Furthermore, the case member of the present invention is suited for receiving a CCD camera unit (which is the electrical part) within the electrical part chamber in a sealed condition.

ADVANTAGE OF THE INVENTION

In the present invention, the pushing-out of the seal member caused by gas leakage within the connector portion, as well as the falling of the annular lip portion of the seal member during the fitting of the connector portion and the mating connector to each other, can be positively prevented.

DESCRIPTION OF THE REFERENCE NUMERALS

Figure 1:
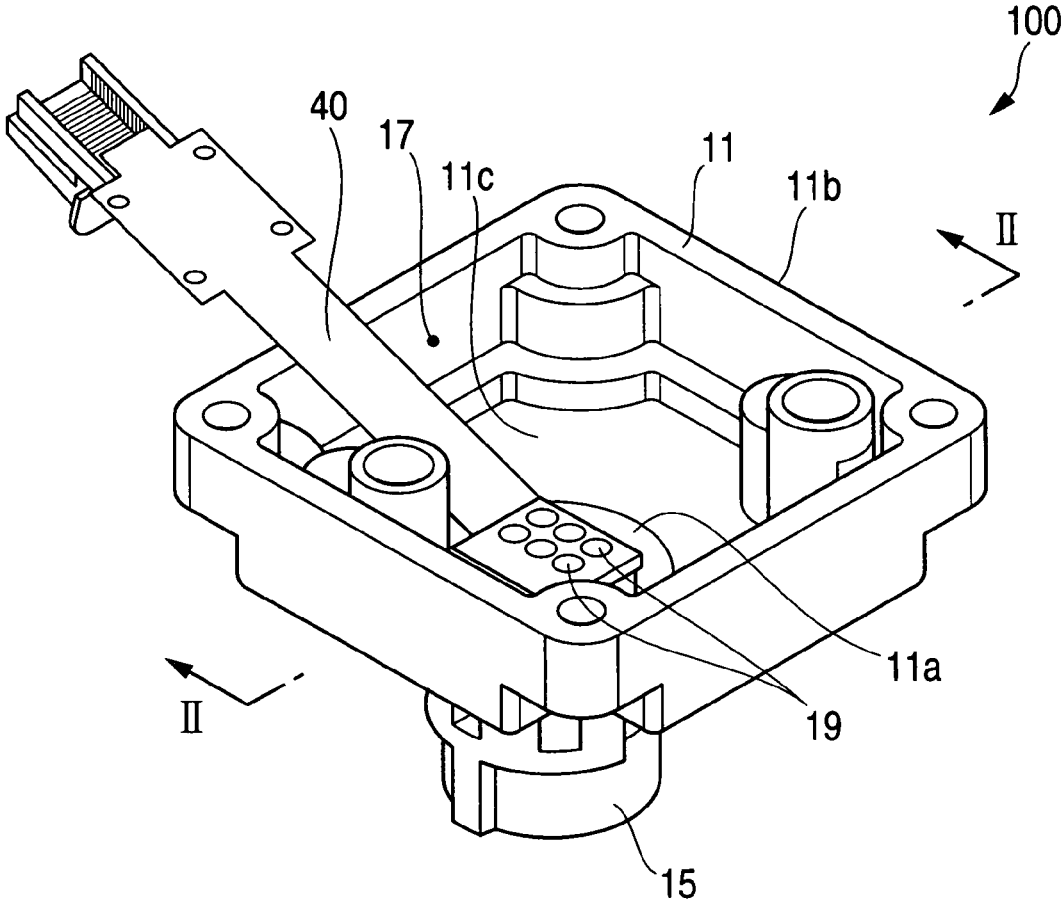
FIG. 1 is a perspective view of one embodiment of a case member (A second case half portion is omitted.) of the present invention.

100 case member
11 first case half portion
11*a* partition wall
12 case portion
13 seal member
13*f* annular lip portion
15 seal member holder
15*f* annular groove
17 electrical part chamber
18 connector portion
19 connection terminal
19*a* one end portion (electrical contact portion) of the connection terminal
21 seal member chamber
23 second case half portion
33 mating connector
50 CCD camera unit (electrical part)

BEST MODE FOR CARRYING OUT THE INVENTION

A preferred embodiment of the present invention will now be described in detail with reference to the drawings.

Figure 2:
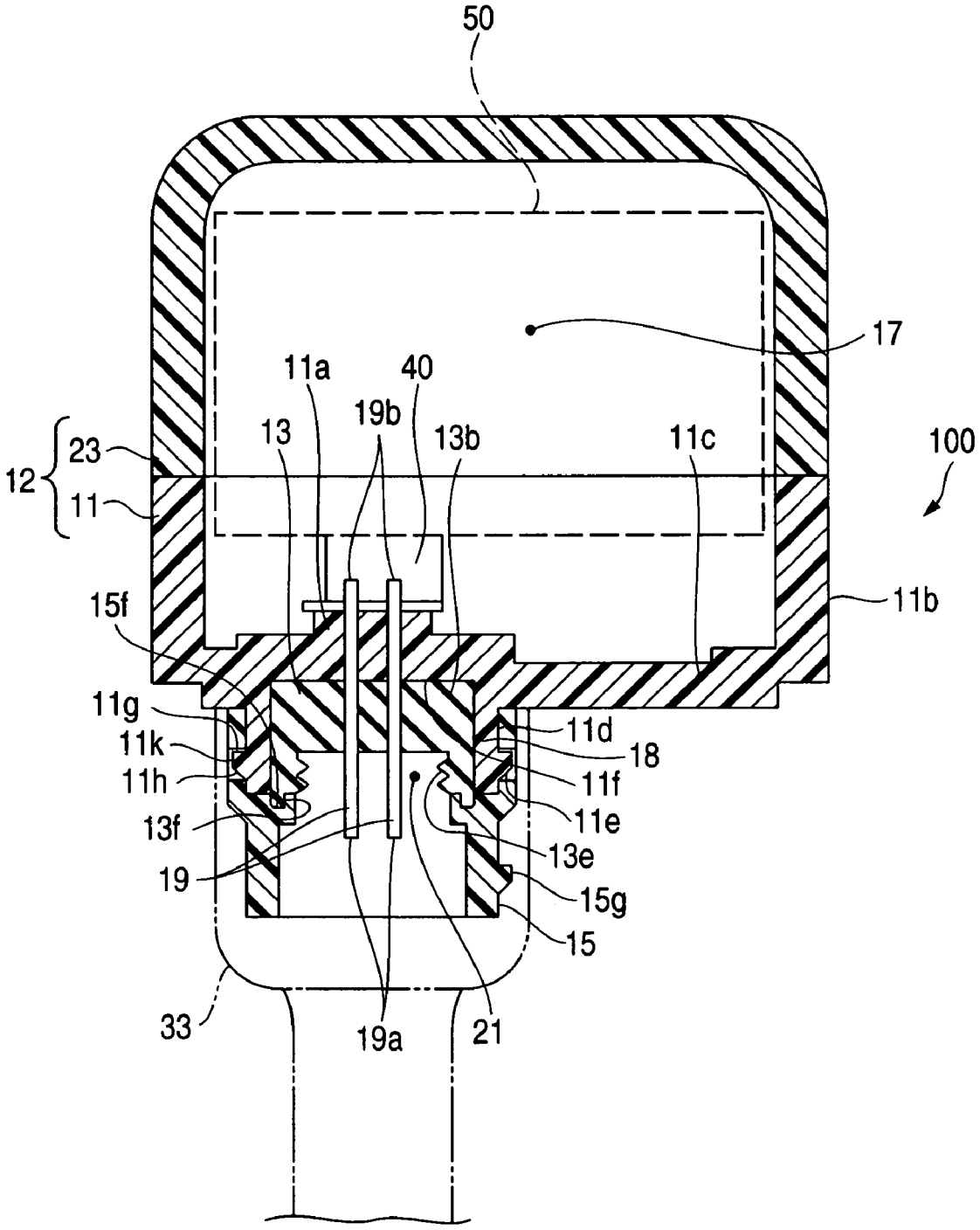
FIG. 2 is a vertical cross-sectional view taken along the line II-II of FIG. 1, showing the case member including the second case half portion.
Figure 3:
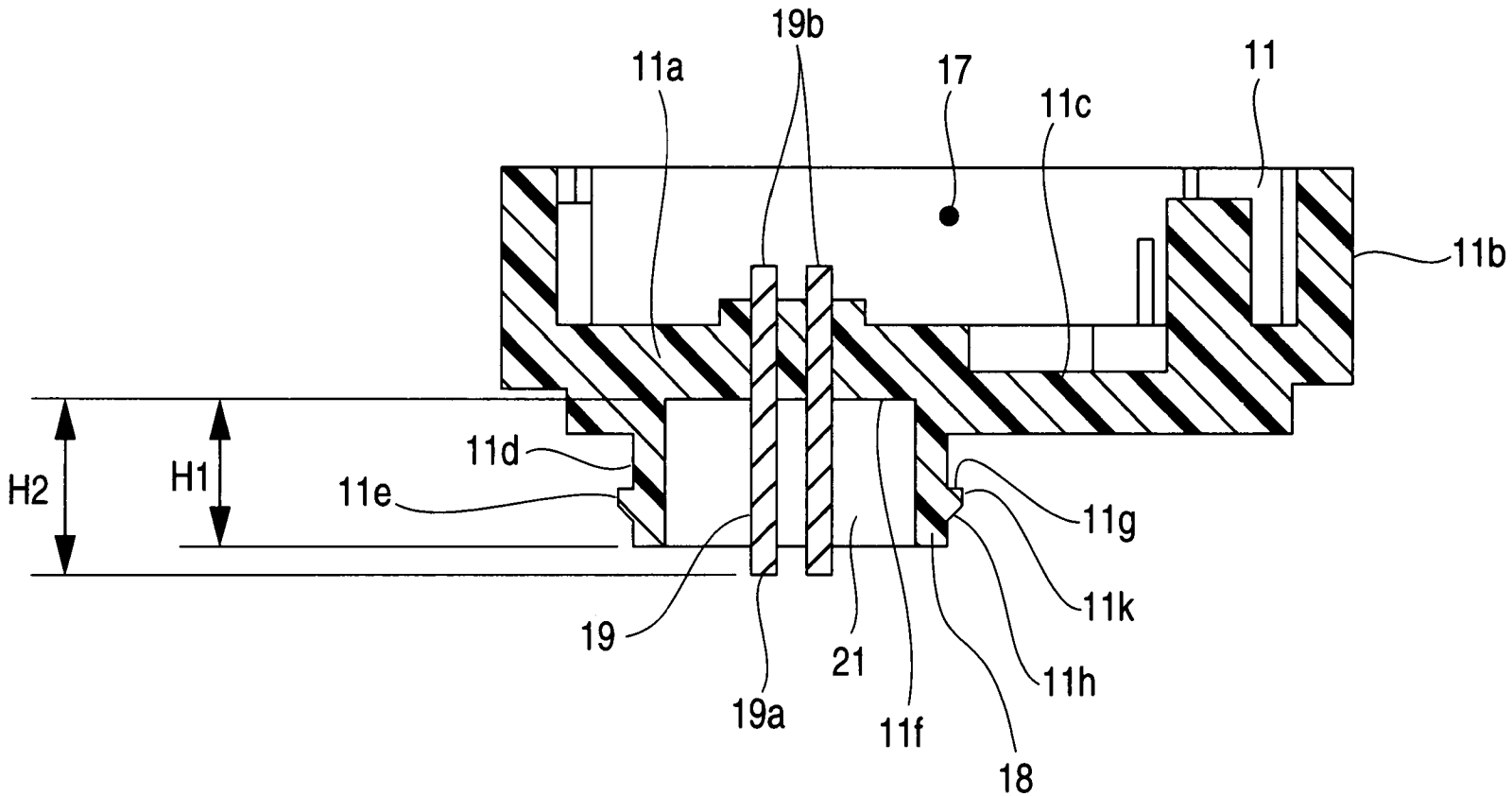
FIG. 3 is a vertical cross-sectional view showing a first case half portion and a connector portion.

As shown in FIGS. 1 to 3, a case member 100 according to one embodiment of the present invention, includes a case portion 12, a connector portion 18, a seal member 13, and a seal member holder 15. An electrical part chamber 17 for receiving an on-vehicle CCD camera unit 50 (that is, an electrical part) is formed within the case portion 12.

The connector portion 18 is formed integrally with the case portion 12. The connector portion 18 includes a seal member chamber 21, a partition wall 11*a* formed between the seal member chamber 21 and the electrical part chamber 17 of the case portion 12 to separate the seal member chamber 21 and the electrical part chamber 17 from each other, and connection terminals 19 which extend through the partition wall 11*a*, and are fixed to this partition wall 11*a*, and have respective electrical contact portions 19*a* projecting into the seal member chamber 21.

The seal member 13 is disposed within the seal member chamber 21 in such a manner that the electrical contact portions 19*a* of the connection terminals 19 extend through this seal member 13. The seal member 13 has an annular lip portion 13*f*.

The seal member holder 15 is fitted on an outer peripheral surface of the connector portion 18. The seal member holder 15 has an annular groove 15*f* which receives the annular lip portion 13*f* of the seal member 13 when the seal member holder is fitted on the connector portion 18.

Details of the case member 100 of this construction will be described below in detail.

Describing the case portion 12 based on its disposition shown in FIG. 2, this case portion 12 includes a synthetic resin-made first case half portion 11 disposed at a lower side, and a synthetic resin-made second case half portion 23 which is disposed at an upper side, and is joined to the first case half portion 11 by a suitable joining method such as ultrasonic welding, and the electrical part chamber 17 is formed within the jointed first case half portion 11 and second case half portion 13, and is kept in a sealed condition.

The first case half portion 11 is formed integrally with the synthetic resin-made connector portion 18, having the electrically conductive metal-made connection terminals 19, by insert molding. The first case half portion 11 is a generally cross-sectionally U-shaped member, and includes a generally rectangular plate-like bottom wall 11*c*, and a side wall 11*b* of a rectangular annular shape formed on and projecting upright from an outer peripheral edge of the bottom wall 11*c*.

The partition wall 11*a* of the connector portion 18 is formed at part of the bottom wall 11*c* of the first case half portion 11, and therefore it can be said that the first case half portion 11 has the partition wall 11*a*. Namely, the partition wall 11*a* is the wall common to the first case half portion 11 and the connector portion 18.

The portion of the electrical part chamber 17, formed at the first case half portion 11, is defined in a generally enclosed manner by an upper surface of the bottom wall 11*c* (that is, a bottom surface of the electrical part chamber 17), including the partition wall 11*a*, and an inner peripheral surface of the side wall 11*b*, and is open at its upper side.

The plurality of straight bar-like male-type connection terminals 19 are provided at the partition wall 11*a* by insert molding in such a manner that the connection terminals 19 extend through the partition wall 11*a*. One end portions (that is, the electrical contact portions) 19*a* of the connection terminals 19 project into the seal member chamber 21, and the other end portions 19*b* of the connection terminals 19 project into the electrical part chamber 17. The CCD camera unit 50 (that is, the electrical part), received in the electrical part chamber 17, is electrically connected to the connection terminals 19 via a flexible flat cable (that is, FFC) 40 electrically connected to the other end portions 19*b* of the connection terminals 19.

A cylindrical wall 11*d* of a generally cylindrical tubular shape is formed on and projects perpendicularly from a lower surface of the bottom wall 11*c* (In other words, the partition wall 11*a*), facing away from the electrical part chamber 17, in surrounding relation to the plurality of connection terminals 19. The seal member chamber 21, formed in the connector portion 18, is defined in a generally enclosed manner by the lower surface 11*f* of the partition wall 11*a* (that is, a bottom surface of the seal member chamber 21) and an inner peripheral surface of the cylindrical wall 11*d*, and is open at its lower side to provide an insertion port for the insertion of an inner housing (not shown) of a mating connector 33 thereinto.

As shown in FIG. 3, a height H1 of the cylindrical wall 11*d* (More specifically, the distance from the bottom surface 11*f* of the seal member chamber 21 to a distal end surface of the cylindrical wall 11*d*) is set to a value smaller than a length of those portions of the connection terminals 19 projecting into the seal member chamber 21, in other words, the distance (height) H2 from the bottom surface 11*f* of the seal member chamber 21 to distal ends of the one end portions 19*a* of the connection terminals 19. Namely, the distal ends of the connection terminals 19 project from the cylindrical wall 11*d*.

A plurality of retaining portions 11*e* for engagement with the seal member holder 15 and a plurality of positioning projections (not shown) are formed on the side surface of the cylindrical wall 11*d*, and are arranged at intervals in a circumferential direction. The retaining portion 11*e* includes a flat surface 11*g* extending radially perpendicularly from the cylindrical wall 11*d*, a slanting surface 11*h* extending in inclined relation to the cylindrical wall 11*d*, and an interconnecting surface 11*k* interconnecting distal ends of the flat surface 11*g* and slanting surface 11*h*.

The seal member 13, mounted within the seal member chamber 21, functions as a seal plug so that the electrical part chamber 17 will not communicate with the exterior of the case member 100 via microscopic gaps formed between the respective connection terminals 19 and the partition wall 11*a*, and this seal member is formed, for example, by an elastic material such as oil-containing silicon rubber.

Figure 4:
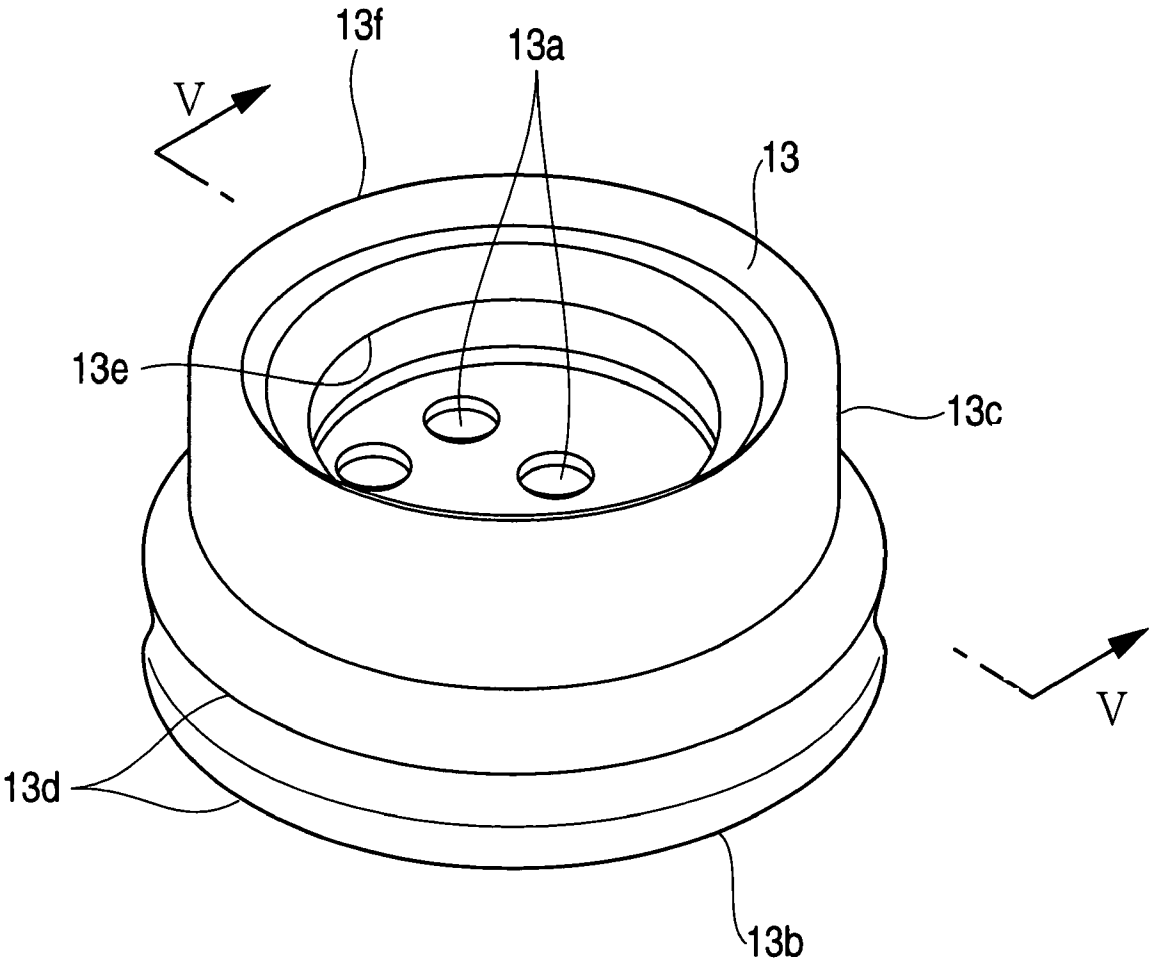
FIG. 4 is a perspective view of a seal member.
Figure 5:
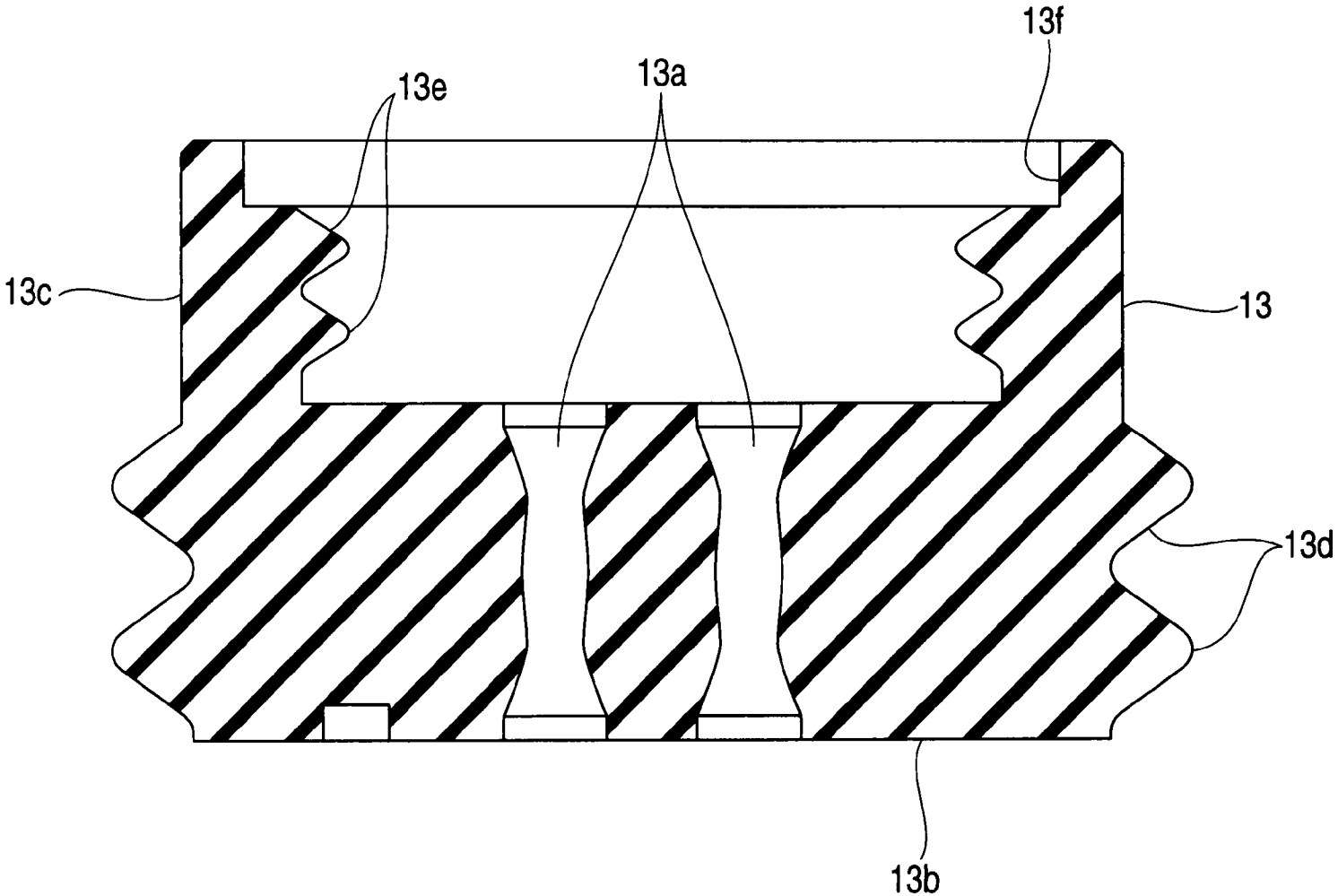
FIG. 5 is a vertical cross-sectional view taken along the line V-V of FIG. 4.

As shown in FIGS. 4 and 5, the seal member 13 includes a seal member body 13*b* of a generally disk-shape having a plurality of terminal passage holes 13*a* formed therethrough in corresponding relation respectively to the plurality of connection terminals 19 arranged in rows on the partition wall 11*a*, and a pipe-like ring portion 13*c* formed on and extending from an outer peripheral edge of this seal member body 13*b* in parallel relation to the direction of the axis of the seal member 13.

The ring portion 13*c* is formed integrally with the seal member body 13*b* such that when the seal member 13 is mounted within the seal member chamber 21, the ring portion 13*c* extends in a direction (a downward direction in FIG. 2) of connecting of the connector portion 18 to the mating connector 33 in surrounding relation to the one end portions 19*a* of the connection terminals 19.

Two parallel annular lip portions 13*d*, each having an outer diameter size slightly larger than an inner diameter size of the seal member chamber 21, are formed on an outer-peripheral surface of the seal member body 13*b*. The outer diameter size of the ring portion 13*c* is equal to the inner diameter size of the seal member chamber 21.

Two parallel annular lip portions 13*e* are formed on an inner peripheral surface of the ring portion 13*c*. An inner diameter size of the annular lip portions 13*e* is set to a value slightly smaller than an outer diameter size of the inner housing (not shown) of the mating connector 33. Therefore, when the inner housing of the mating connector 33 is inserted into the seal member chamber 21 of the connector portion 18*a*, while deforming the annular lip portions 13*e*, a seal is formed between the mating connector 33 and the connector portion 18. Thus, the inner housing of the mating connector 33 is fitted in the connector portion 18.

The annular lip portion 13*f* is formed on and extends from the distal end of the ring portion 13*c* in parallel relation to the direction of the axis of the seal member 13. This annular lip portion 13*f* is formed integrally with the ring portion 13*c* such that when the seal member 13 is mounted within the seal member chamber 21, the annular lip portion 13*f*, like the ring portion 13*c*, extends in the direction (the downward direction in FIG. 2) of connecting of the connector portion 18 to the mating connector 33 in surrounding relation to the one end portions 19*a* of the connection terminals 19. In other words, the annular lip portion 13*f* extends from the ring portion 13*c* of the seal member 13 in parallel relation to the direction of extending of the connection terminals 19.

Figure 6:
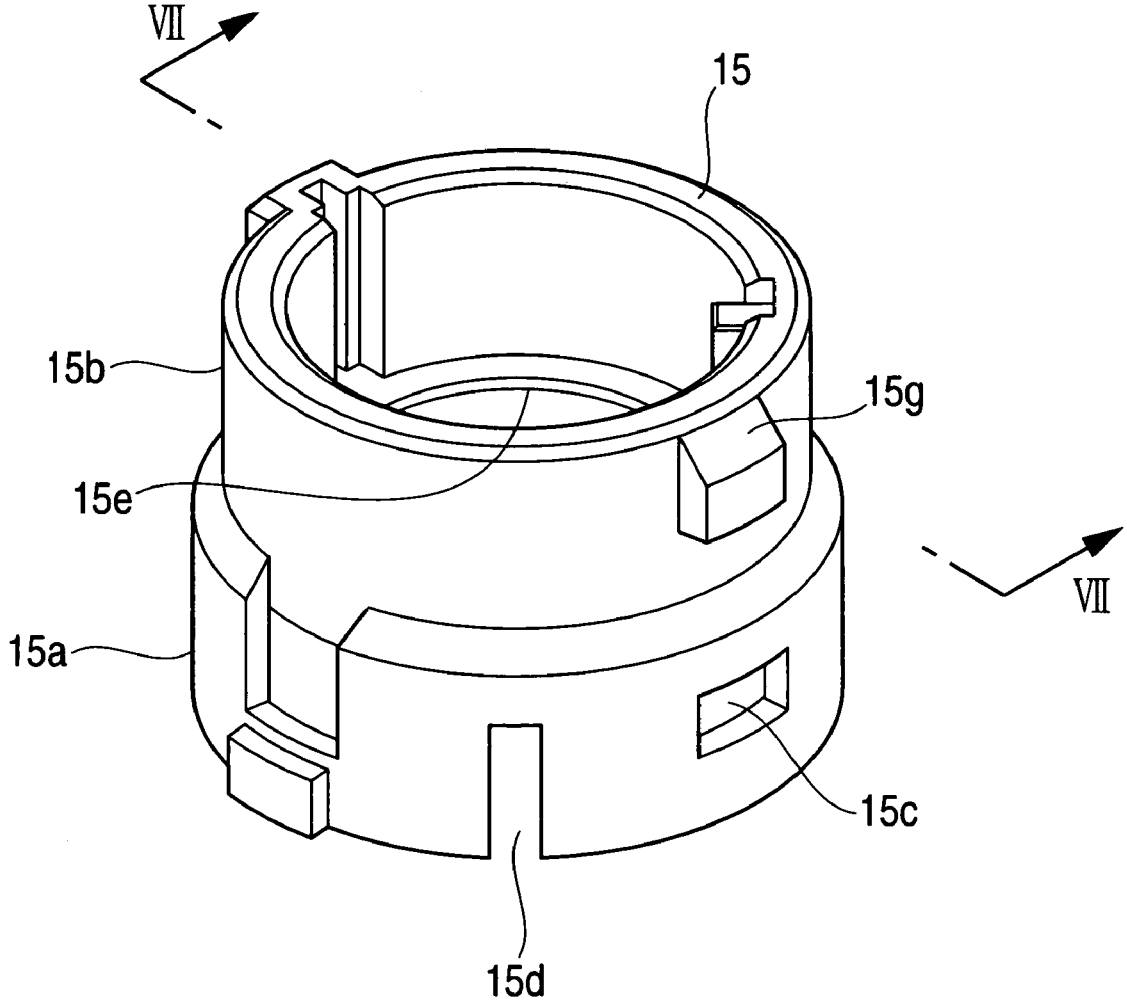
FIG. 6 is a perspective view of a seal member holder.
Figure 7:
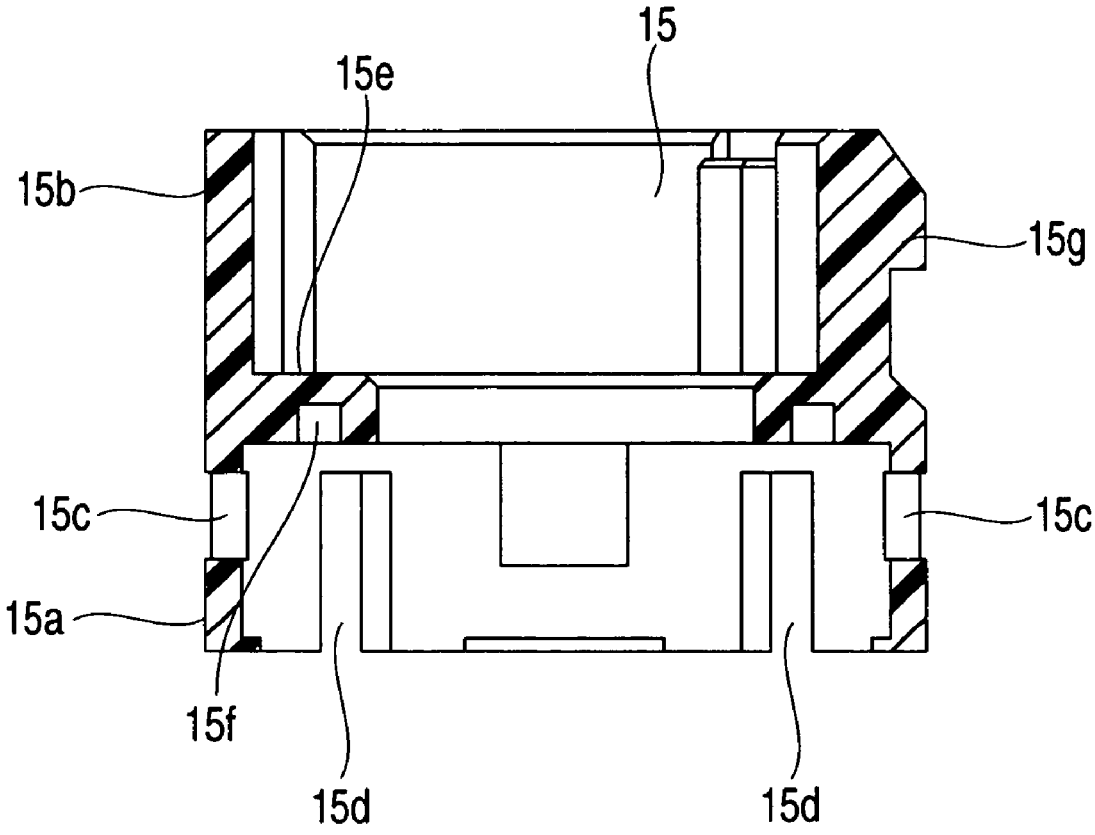
FIG. 7 is a vertical cross-sectional view taken along the line II-II of FIG. 6.

As shown in FIGS. 6 and 7, the seal member holder 15 is formed into a generally hollow cylindrical shape, using a synthetic resin, and has a larger-diameter portion 15*a* and a smaller-diameter portion 15*b* which are continuous with each other. An inner diameter size of the larger-diameter portion 15*a* is equal to the outer diameter of the cylindrical wall 11*d*, and this larger-diameter portion is adapted to be fitted on the cylindrical wall 11*d*. A plurality of engagement holes 15*c* and a plurality of U-shaped positioning grooves 15*d* are formed respectively in those portions of a side surface of the larger-diameter portion 15*a* corresponding respectively to the retaining portions 11*e* and the positioning projections (not shown) of the cylindrical wall 11*d*. When the seal member holder 15 is fitted on the cylindrical wall 11*d*, the positioning projections (not shown) are engaged in the respective positioning grooves 15*d* to thereby determine a circumferential phase, and the retaining portions 11*e* are engaged in the respective engagement holes 15*c*, thereby preventing withdrawal of the seal member holder 15 from the cylindrical wall 11*d*.

A ring-like projection 15*e* is formed on an inner peripheral surface of a joined portion between the larger-diameter portion 15*a* and the smaller-diameter portion 15*b*. The annular groove 15*f*, corresponding to the annular lip portion 13*f* of the seal member 13, is formed in a flat surface portion of this ring-like projection 15*e* disposed close to the larger-diameter portion 15*a*, and the annular lip portion 13*f* can be received in the annular groove 15*f*. A retaining portion 15*g* for engagement with an engagement hole (not shown) formed in the mating connector 33 is formed on an outer peripheral surface of the smaller-diameter portion 15*b*.

Next, a procedure of assembling the case member 100 will be described. As shown in FIG. 2, first, the distal ends of the one end portions 19*a* of the connection terminals 19 are slightly inserted respectively into the plurality of terminal passage holes 13*a* formed in the seal member body 13*b*, thereby positioning the seal member 13 in the circumferential direction. At this time, the cylindrical wall 11*d* will not be an obstacle since the distal ends of the one end portions 19*a* of the connection terminals 19 project from the distal end of the cylindrical wall 11*d* by an amount equal to the difference (H2-H1) between their heights as shown in FIG. 3, and the circumferential phase of the seal member 13 relative to the cylindrical wall 11*d* (the connection terminals 19) can be easily determined in a short time while angularly moving the seal member 13. Then, the seal member 13 is forced into the seal member chamber 21, and is brought into intimate contact with the inner peripheral surface of the seal member chamber 21 while squeezing the two annular lip portions 13*d*, and also the terminal passage holes 13*a* are brought into intimate contact with the outer peripheral surfaces of the respective connection terminals 19.

Next, the positioning projections (not shown) on the cylindrical wall 11*d* of the connector portion 18 are slightly inserted respectively into the positioning grooves 15*d* in the seal member holder 15, thereby determining the circumferential phase of the seal member holder 15 relative to the cylindrical wall 11*d*, and the seal member holder 15 is slightly fitted on the cylindrical wall 11*d*. Then, in this condition, the seal member holder 15 is pushed, and the engagement holes 15*c* are brought into engagement with the respective retaining portions 11*e* of the cylindrical wall 11*d* while the annular lip portion 13*f* of the seal member 13 is received in the annular groove 15*f* of this seal member holder, thus completing the mounting of the seal member holder 15 on the cylindrical wall 11*d*. In the condition in which the seal member holder 15 is completely fitted on the cylindrical wall 11*d* of the connector portion 18, the annular lip portion 13*f* is squeezed within the annular groove 15*f*, and is bulged radially outwardly into intimate contact with the inner surface of the annular groove 15*f*.

The electrical part chamber 17 is positively sealed by the two annular lip portions 13*d* of the seal member 13 held in intimate contact with the inner peripheral surface of the seal member chamber 21, the terminal passage holes 13*a* having the connection terminals 19 passed therethrough, and the annular lip portion 13*f* received in the annular groove 15*f* of the seal member holder 15.

In the case member 100 of the above construction, the seal member holder 15 is mounted on the connector portion 18 while the annular lip portion 13*f* of the seal member 13 is received in the annular groove 15*f* of this seal member holder, and therefore this positively prevents a situation in which the mating connector 33 is fitted into the connector portion 18, with the annular lip portion 13*f* of the seal member 13 falling inwardly (that is, toward the connection terminals 19) into a folded condition. And besides, even when the seal member 13 tends to be pushed out by gas leaking from the case portion 12 into the seal member chamber 21 via the gaps between the respective connection terminals 19 and the partition wall 11*a*, the seal member holder 15 stops the seal member 13, and therefore the pushing-out of the seal member 13 is also positively prevented.

Thus, in the case member 100, the falling of the annular lip portion 13*f* of the seal member 13 can be positively prevented when fitting the mating connector 33 into the connector portion 18 of this case member, and therefore this case member is suited for receiving a precision electrical part such as the above-mentioned CCD camera unit 50 which dislikes foreign matters such as dirt, dust, water and others.

The present invention is not limited to the above-mentioned embodiment, and modifications, improvements, etc., can be suitably made. And besides, the material, shape, dimensions, numerical value, form, number, disposition, etc., of each of the constituent elements of the above-mentioned embodiment are arbitrary, and are not limited in so far as the present invention can be achieved.

For example, in the above-mentioned embodiment, although the seal member, the seal member holder and the connector portion have the respective circular annular portions, it is needless to say that these may have the respective annular portions of other shape.

The electrical part to be suitably received within the case member of the present invention is not limited to the above-mentioned CCD camera unit, and the merits (excellent ability) of the case member of the present invention can be exhibited for any of electrical parts which require the receiving body to have a high gas-tight performance (In other words, a high sealing performance) so as to avoid foreign matters such as dirt, dust, water, etc.

Although the present invention has been described in detail with reference to the specific embodiment, it will be apparent to those skilled in the art that various changes and modifications can be added without departing from the spirit and the scope of the present invention.

The present Application is based on Japanese Patent Application (Patent Application No. 2004-140195) filed on May 10, 2004, and contents thereof are incorporated herein for reference.

The invention claimed is:

1. A case member, comprising:

a case portion that has an electrical part chamber formed therein for receiving an electrical part;

a connector portion that is integrally formed with the case portion, and includes:

a seal member chamber;

a partition wall formed between the seal member chamber and the electrical part chamber to separate the seal member chamber from the electrical part chamber of the case portion; and a connection terminal fixed to the partition wall so as to pass through the partition wall, and has an electrical contact portion projecting into the seal member chamber;

a seal member having a terminal hole disposed within the seal member chamber so that the electrical contact portion of the connection terminal passes through the hole of the seal member; and a seal member holder that is fitted on an outer peripheral surface of the connector portion, wherein the seal member has an annular lip portion at an edge thereof which has an inner peripheral surface and an outer peripheral surface extending in a connection direction in which the connector portion connects to a mating connector so as to surround the electrical contact portion of the connection terminal; and wherein the seal member holder has an inner annular groove which receives the annular lip portion of the seal member so as to support the inner peripheral surface and the outer peripheral surface of the annular lip portion when the seal member holder is fitted on the connector portion.

2. The case member according to claim 1, wherein the electrical part is a Charged Coupled Device (CCD) camera unit; and wherein the CCD camera unit is received in the electrical part chamber in a sealed condition.

* * * * *